US010351404B1

(12) United States Patent
Sanford

(10) Patent No.: US 10,351,404 B1
(45) Date of Patent: Jul. 16, 2019

(54) TENT STAKE REMOVAL TOOL

(71) Applicant: Arlington Sanford, Summerville, SC (US)

(72) Inventor: Arlington Sanford, Summerville, SC (US)

( * ) Notice: Subject to any disclaimer, the term of this patent is extended or adjusted under 35 U.S.C. 154(b) by 0 days.

(21) Appl. No.: 15/952,337

(22) Filed: Apr. 13, 2018

Related U.S. Application Data

(60) Provisional application No. 62/561,271, filed on Sep. 21, 2017.

(51) Int. Cl.
*B66F 15/00* (2006.01)
*E04H 15/62* (2006.01)

(52) U.S. Cl.
CPC ..... *B66F 15/00* (2013.01); *E04H 15/62* (2013.01)

(58) Field of Classification Search
CPC ..... B66F 3/00; B66F 7/00; B66F 19/00
See application file for complete search history.

(56) References Cited

U.S. PATENT DOCUMENTS 373,663 A 11/1887 Hyde
549,555 A 11/1895 White
3,823,430 A 7/1974 Welsh et al.
4,112,530 A 9/1978 Lecce et al.
5,022,632 A * 6/1991 Beideck ..... B25B 27/02 254/132
5,186,437 A * 2/1993 Scott ..... B66C 1/62 254/132
D340,852 S 11/1993 Sanders et al.
5,499,795 A * 3/1996 Mathews ..... E04H 17/265 254/30
5,713,557 A * 2/1998 Kang ..... B66F 15/00 254/120
5,775,674 A * 7/1998 Bigham ..... B66F 15/00 254/130
5,833,215 A * 11/1998 Vandenburg ..... E04H 17/265 254/30
5,934,649 A 8/1999 Drane
6,302,376 B1 * 10/2001 Williams ..... B66F 15/00 254/30
6,349,514 B1 * 2/2002 Adams ..... A01G 9/122 135/118
6,634,047 B2 10/2003 Rowland
D539,868 S * 4/2007 Luster ..... D22/199
D679,457 S 4/2013 Chance et al.
2017/0268253 A1 * 9/2017 Boswell ..... E04H 15/62

* cited by examiner

*Primary Examiner* — Lee D Wilson
(74) *Attorney, Agent, or Firm* — Cramer Patent & Design, PLLC; Aaron R. Cramer

(57) ABSTRACT

A tie down system includes a tie down stake and a tie down stake removal device. The tie down stake includes a central shaft, an impact head, a pointed tip, and a plurality of barbs projecting outwardly from the central shaft. The tie down stake removal device includes a post stand, a post connected to the post stand, a lower lever pivotally connected to the post, an upper lever connected to the lower lever, and a removal bracket located on the lower lever.

13 Claims, 7 Drawing Sheets

TENT STAKE REMOVAL TOOL

RELATED APPLICATIONS

The present invention is a continuation-in-part of and claims the benefit of U.S. Provisional Application No. 62/561,271 filed on Sep. 21, 2017, the entire disclosures of which are incorporated herein by reference.

FIELD OF THE INVENTION

The present invention relates to tie down stakes and, more particularly, to a device for the removal of tie down stakes.

BACKGROUND OF THE INVENTION

It is often necessary to temporarily anchor outdoor items with a tie down stake. Such items include tents, dining canopies, tarps, lawn decorations, and the like. Most often these stakes are pounded into the ground with a hammer and then pulled out with bare hands, neither of which task is easy. While insertion into soft earth or sand is relatively easy, most people do not have that luxury. Instead, they are forced to pound on it relentlessly, risking damage to the top of the stake. Then, even after such effort, it seems to dislodge by itself even under the slightest pressure. Other times, the stake cannot be removed afterwards even with maximum force applied. Many times, the stake must be abandoned where it poses a tripping hazard for others and leaves the user without a full set of stakes jeopardizing future use. Accordingly, there exists a need for a means by which a ground stakes can be easily inserted and removed without the disadvantages as described above.

SUMMARY OF THE INVENTION

The inventor has recognized the aforementioned, inherent problems and lack in the art and observed that there is a need for a new and improved system for securing items to the ground. The development of the present invention, which will be described in greater detail herein, fulfills this need.

In an embodiment, the disclosed tie down system includes a tie down stake and a tie down stake removal device. The tie down stake includes a central shaft, an impact head, a pointed tip, and a plurality of barbs projecting outwardly from the central shaft. The tie down stake removal device includes a post stand, a post connected to the post stand, a lower lever pivotally connected to the post, an upper lever connected to the lower lever, and a removal bracket located on the lower lever.

In another embodiment, the disclosed tie down stake includes a central shaft that includes a first shaft end and a second end, opposite the first shaft end, an impact head, located at the first shaft end of the central shaft, a pointed tip, located at the second shaft end of the central shaft, and a plurality of barbs, projecting outwardly from the central shaft and located between the first shaft end of the central shaft and the second shaft end of the central shaft.

In another embodiment, the disclosed tie down stake removal device includes a post stand, a post that includes a first post end, connected to the post stand, and a second post end, opposite the first post end, a lower lever that includes a first lower lever end, and a second lower lever end, opposite the first lower lever end, the lower lever being pivotally connected to the second post end of the post between the first lower lever end and the second lower lever end, an upper lever that includes a first upper lever end, connected to the lower lever between the post and the second lower lever end of the lower lever, and a second upper lever end, opposite the first upper lever end, and a removal bracket, located on the first lower lever end of the lower lever.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWINGS

The advantages and features of the embodiments and examples disclosed herein will become better understood with reference to the following more detailed description and claims taken in conjunction with the accompanying drawings, in which like elements are identified with like symbols, and in which:

DESCRIPTIVE KEY

Figure 1:
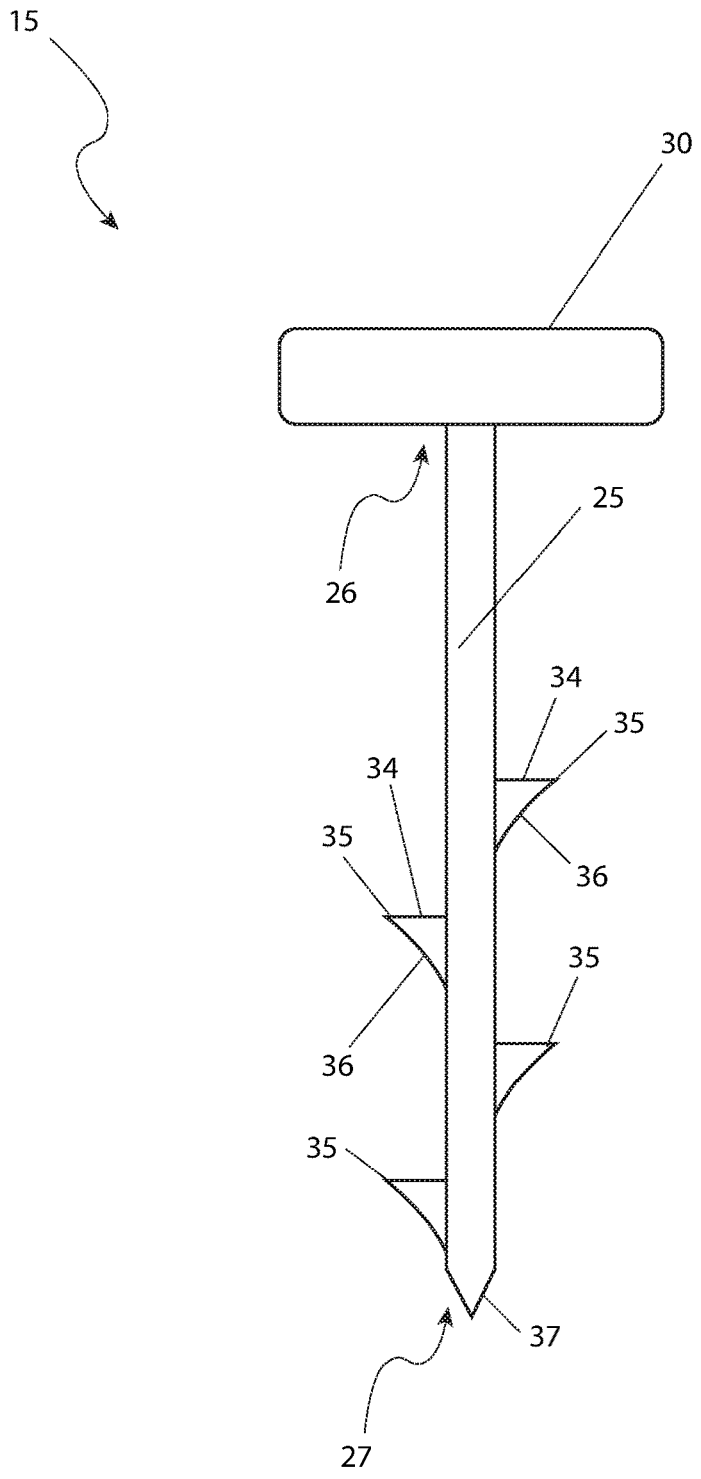
FIG. 1 is an elevational view of an embodiment of a tie down stake of the disclosed tie down system.

10 tie down system
15 tie down stake
20 tie down stake removal device
25 central shaft
26 first shaft end
27 second shaft end
30 impact head
34 first barb surface
35 barb
36 second barb surface
37 pointed tip
40 post stand
45 post
46 first post end
47 second post end
50*a* lower lever
50*b* alternate lower lever
51 first lower lever end
52 second lower lever end
53 lever member
55*a* bearing
55*b* alternate bearing
56 aperture

60 axle pin
65*a* removal bracket
65*b* alternate removal bracket
66 bracket member
67 bracket arm
70 upper lever
71 first upper lever end
72 second upper lever end
75 "T"-shaped connector
80 grade
85 downward force
90 upward force
95 gap
100 stake supported structure
105 guy rope

DETAILED DESCRIPTION OF THE PREFERRED EMBODIMENT

In accordance with the invention, the best mode is presented in terms of the illustrative example embodiments, herein depicted within FIGS. 1-7. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one (1) particular configuration may be shown and described for purposes of clarity and disclosure and not by way of limitation of scope.

As used herein, the singular terms "a," "an," and "the" include plural referents unless the context clearly dictates otherwise. Thus, for example, reference to an object can include multiple objects unless the context clearly dictates otherwise.

As used herein, the terms "connect," "connected," and "connection" refer to a coupling or linking. Connected objects can be directly coupled to one (1) another or can be indirectly coupled to one (1) another, such as via another object.

As used herein, the terms "first," "second," etc. are used merely as labels and do not impose any positional or hierarchical requirements on the item to which the term refers.

As used herein, relative terms, such as "inner," "interior," "outer," "exterior," "top," "bottom," "front," "rear," "back," "left," "right," "upper," "lower," "inside," "outside," "upwardly," "downwardly," "vertical," "vertically," "lateral," "laterally," "above," "below," and similar terms reference relative example positions and/or orientations of the item, element, or feature to which the term refers, for example, as illustrated in the accompanying drawings, but may or may not require a particular position and/or orientation during manufacture and/or use.

In the following description, various illustrative embodiments of the disclosed electrical junction box are provided, which may be practiced without some or all of the particular elements associated with any one (1) of the disclosed embodiments. In some instances, details of known devices and/or processes have been omitted to avoid unnecessarily obscuring the disclosure. While some examples will be described in conjunction with specific illustrated embodiments, these examples are not intended to be limiting. As such, reference herein to "an embodiment," "another embodiment," "an example," and "another example" means that one (1) or more element described in connection with that embodiment or example is included in at least one (1) implementation of the disclosed electrical junction box.

Referring generally to FIGS. 1-7, disclosed is a tie down system, referred to here as the system, 10 where like reference numerals represent similar or like parts. Generally, the disclosed system 10 includes a tie down stake, referred to herein as the stake, 15 and a tie down stake removal device, referred to herein as the device, 20.

Referring to FIG. 1, in an example, the disclosed stake 15 includes a central shaft 25, an impact head 30, and one (1) or more barbs 35. In an example, the central shaft 25 has a circular shape in cross-section. The impact head 30 is located at, or on, one (1) end of the central shaft 25. The other end of the central shaft 25, opposite the impact head 30, terminates at a pointed tip 37 that aids in insertion of the stake 15 into hard ground surfaces.

In an example, the central shaft 25 includes a first shaft end 26 and a second shaft end 27 opposite the first end 26. The impact head 30 is located at the first shaft end 26 of the central shaft 25. The pointed tip 37 is located at the second shaft end 27 of the central shaft 25. A plurality of barbs 35 project outwardly from the central shaft 25. The plurality of barbs 35 are located between the first shaft end 26 of the central shaft 25 and the second shaft end 27 of the central shaft 25. In an example, each one (1) of the plurality of barbs 35 is longitudinally spaced apart from another one (1) of the plurality of barbs 35 along a length of the central shaft 25. In an example, each one (1) of the plurality of barbs 35 is are radially spaced apart from another one (1) of the plurality of barbs 35 about a circumference of the central shaft 25. In an example, each one (1) of the plurality of barbs 35 includes a first barb surface 34, projecting perpendicularly outward from the central shaft 25, and, a second barb surface 36, extending inward from the first bard surface 34 (e.g., from an end of the first barb surface 34 opposite the central shaft 25) to the central shaft 25. In an example, the first barb surface 34 is flat and the second barb surface 36 has a concave curve.

In various examples, the central shaft 25, the impact head 30, and/or the barbs 35 are made of any one (1) or more materials having suitable strength characteristics including, but not limited to: metal (e.g., steel, stainless steel, aluminum or the like), impact resistant plastic, composite, fiberglass, and the like or combinations thereof. In an example, the central shaft 25, the impact head 30, and the barbs 35 of the stake 15 are cast, stamped, or molded to form a single, unitary component. In other examples, different manufacturing methods are also contemplated with equal effectiveness.

In various examples, the dimensions of the stake 15 vary, for example, depending upon a specific implementation or application. In an example, the central shaft 25 is approximately twelve inches (12 in.) in length and approximately three-quarters of an inch (¾ in.) in diameter. In an example, the impact head 30 is approximately four inches wide (4 in.) and three-quarters of an inch (¾ in) thick.

In an example implementation of use, the stake 15 is used by driving the central shaft 25 into the ground, for example, by impacting the impact head 30 with a tool such as a hammer. The barbs 35 provide for enhanced performance of the stake 15 by aiding the stake 15 in remaining in the ground, particularly is soft and/or loose ground. Beneficially, the barbs 35 prevent unintentional removal of the stake 15 from the ground. In various example implementations, the stake 15 can be used to tie down portions (e.g., ends or edges) of tents, tarps, dining canopies, awnings, and similar items.

Figure 2:
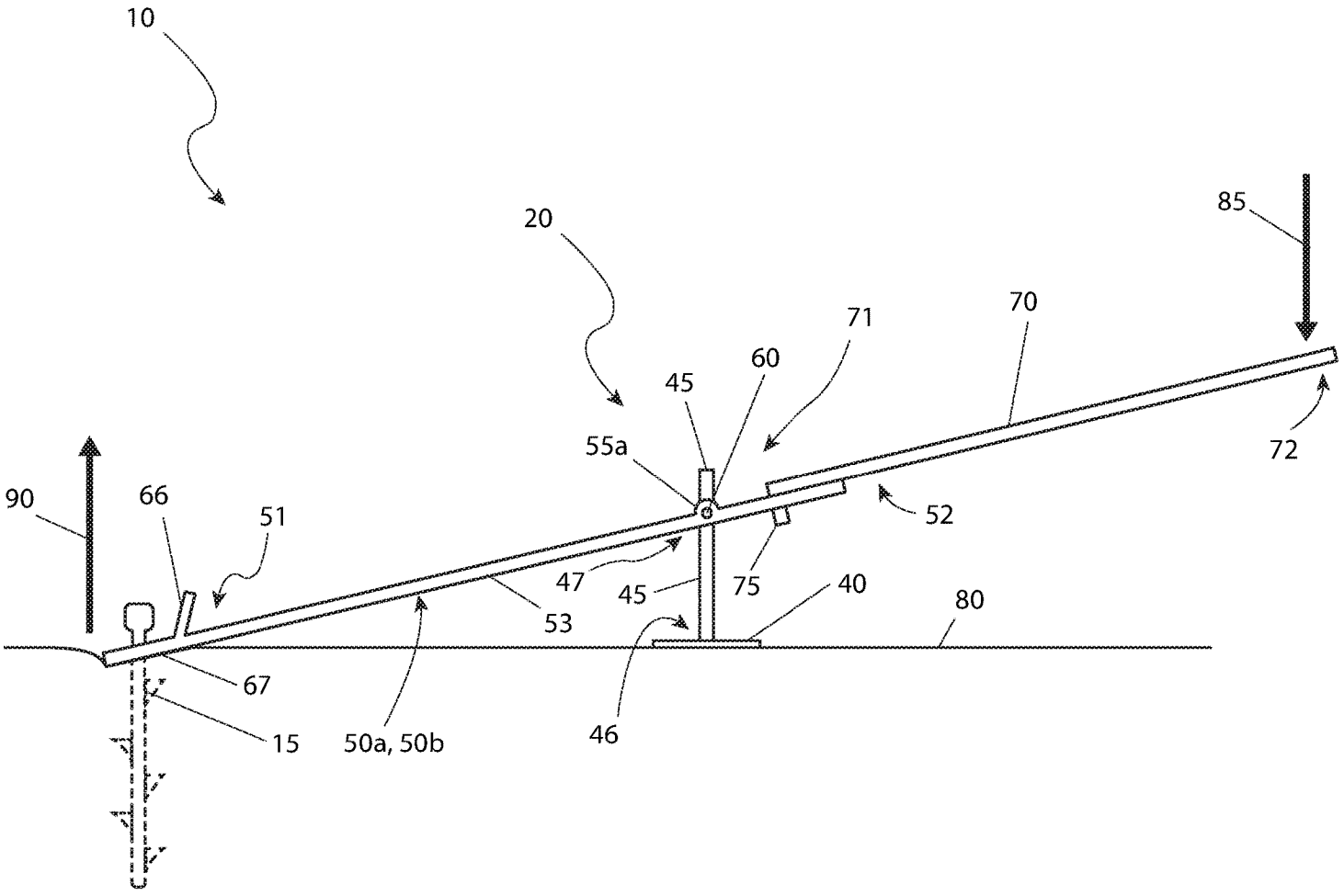
FIG. 2 is an environmental, elevational view of an embodiment of a tie down stake removal device of the disclosed tie down system, shown engaged with the disclosed tie down stake.

Referring to FIG. 2, an example of the disclosed device 20 includes a post stand 40 and a post 45. The post 45 is connected to the post stand 40. The post stand 40 supports the post 45 in an approximately vertical orientation relative to the post stand 40. In an example, the post 45 is fixed in the vertical orientation relative to the post stand 40 and extends upward from the post stand 40. In an example, the post 45 includes a first post end 46, connected to the post stand 40, and a second post end 47, opposite the first post end 46.

In various example, the dimensions of the post stand 40 vary depending, for example, on the particular implementation, application, and/or construction. In an example, the post stand 40 is approximately five inches square (5 in.$^2$) and one-quarter inch (¼ in.) thick. In various examples, the dimensions of the post 45 vary depending, for example, on the particular implementation, application, and/or construction. In an example, the post 45 is approximately twenty-four inches (24 in.) long and one-half inch (½ in.) wide, in cross-section. In an example construction, the post 45 is made from square stock.

In an example, the device 20 includes a lower lever 50*a*, 50*b*. In an example, the lower lever 50*a*, 50*b* is a dual-member lever. In an example, the lower lever 50*a*, 50*b* is connected to the upper second end 47 of the post 45, opposite the post stand 45. In an example, the lower lever 50*a*, 50*b* includes a first lower lever end 51 and a second lower lever end 52 opposite the first lower lever end 51. In an example, the lower lever 50*a*, 50*b* is pivotally connected to the second post end 47 of the post 45 between the first lower lever end 51 and the second lower lever end 52. In an example, the lower lever 50*a* is pivotally connected to the second post end 47 of the post 45 by a bearing 55*a* and an axle pin 60 through an aperture 62 located in the post 45. In an example, the lower lever 50*a* is pivotally connected to the second post end 47 of the post 45 between an approximate middle of the lower lever 50*a* and the second lower lever end 52 of the lower lever 50*a*. In another example, the alternate lower lever 50*b* is pivotally connected to the second post end 47 of the post 45 by a bearing 55*a* and an axle pin 60 through an alternate bearing 55*b* extending away from a first side of the post 45.

Figure 3:
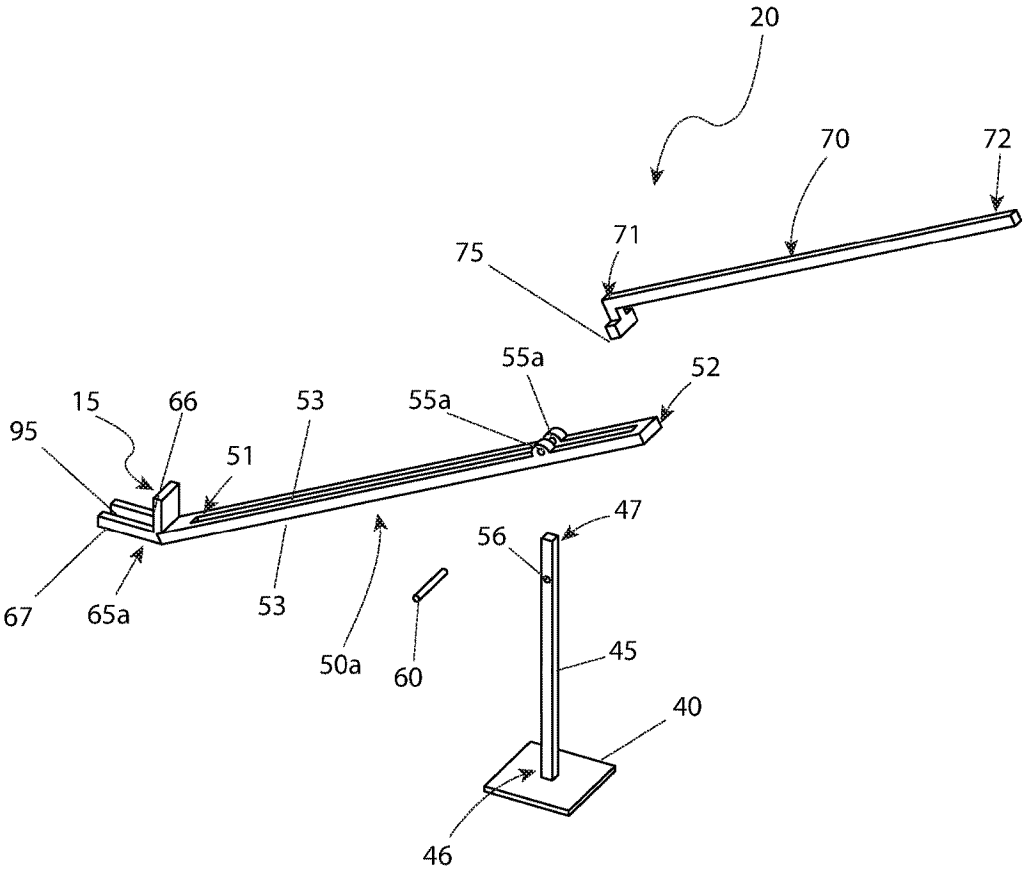
FIG. 3 is a perspective, exploded view of an embodiment of the disclosed stake removal device.
Figure 4:
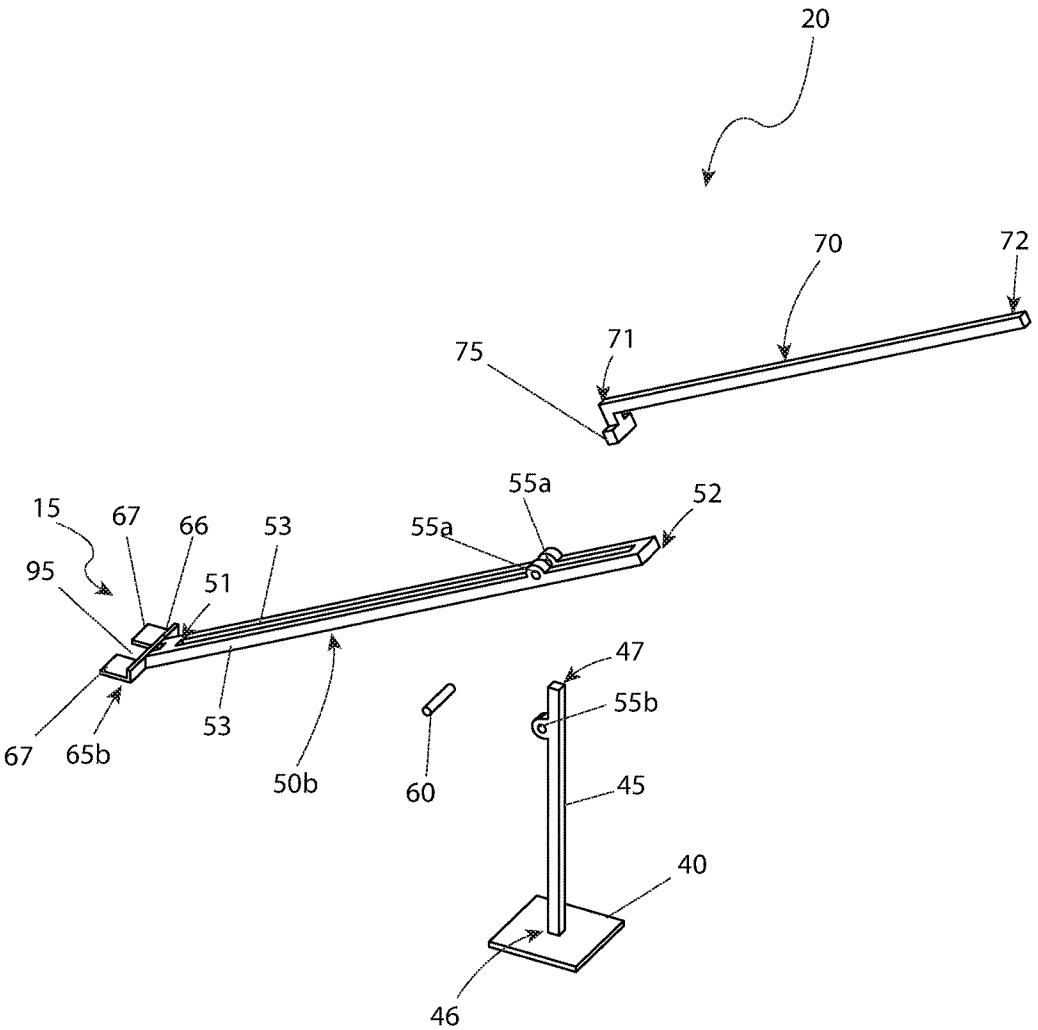
FIG. 4 is a perspective view of the disclosed stake removal device, shown engaged with the disclosed tie down stake.
Figure 5:
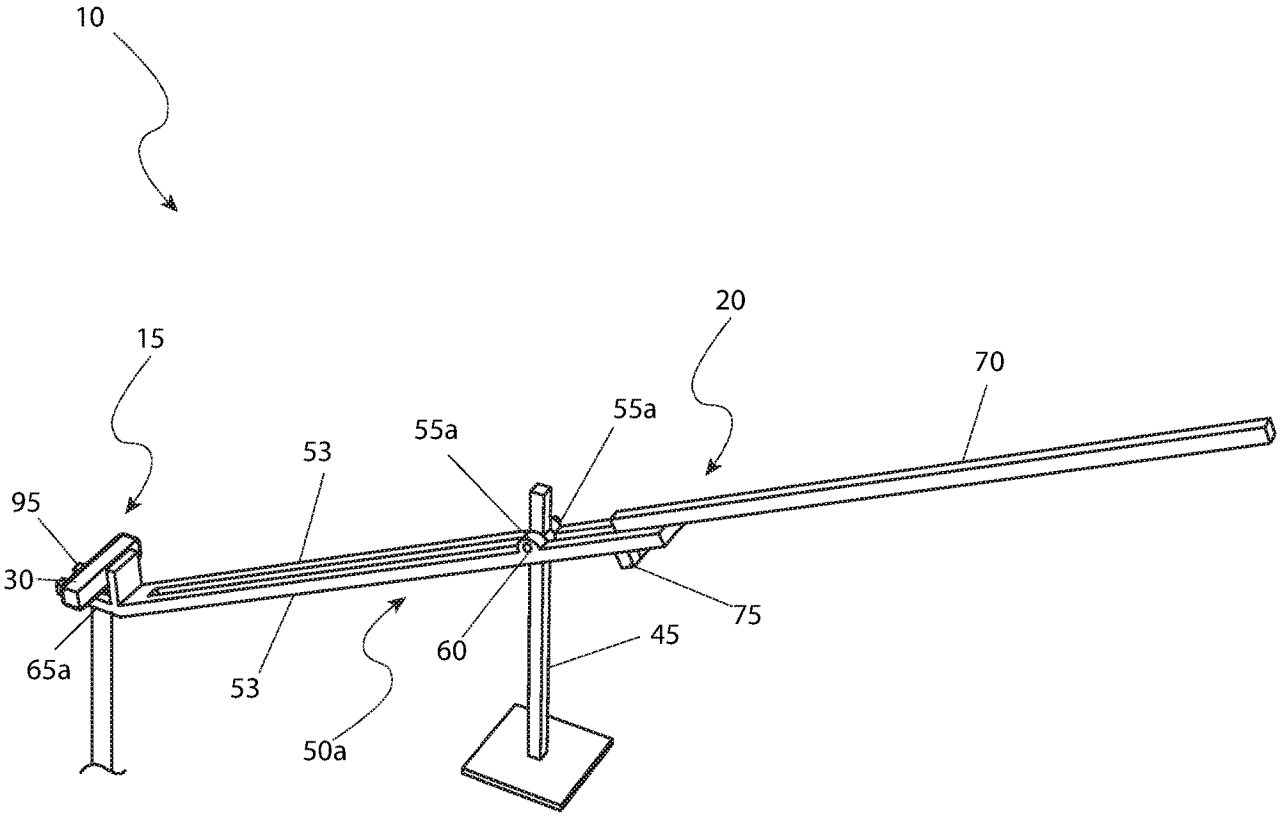
FIG. 5 is a perspective, exploded view of another embodiment of the disclosed stake removal device.
Figure 6:
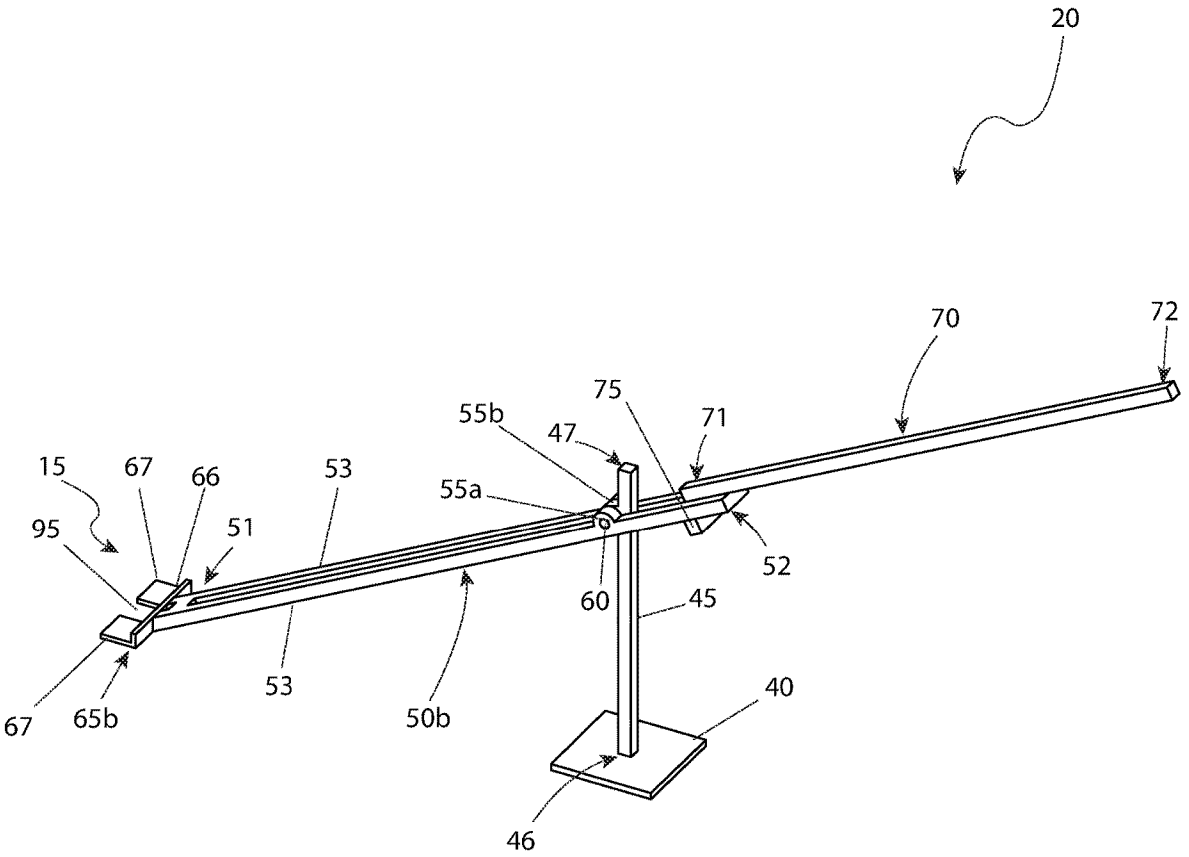
FIG. 6 is a perspective view of another disclosed stake removal device, shown engaged with the disclosed tie down stake; and, FIG. 7 is an environmental, perspective view of the disclosed tie down system.

In an example, the device 20 includes a removal bracket 65*a*, 65*b* connected to or otherwise located on the first (e.g., distal) end 51 of the lower lever 50*a*, 50*b*. In an example, the removable bracket 65*a*, 65*b* has a general "L"-shape, in side view (FIG. 2) and a "U"-shape in top view (FIG. 3, FIG. 4).

In an example, the device 20 includes an upper lever 70. In an example, the upper lever 70 is a single-member lever. In an example, the upper lever 70 is removably connected to the second (e.g., proximal) end of the lower lever 50*a*, 50*b*, for example, by a "T"-shaped connector 75 that is connected to the dual lower lever 50*a*, 50*b* via a ninety degree) (90° alternate insertion angle and then linearly aligned with the dual lower lever 50*a*, 50*b*. In an example, the upper lever 70 includes a first upper lever end 71, connected to the lower lever 50*a*, 50*b* between the post 45 and the second lower lever end 52 of the lower lever 50*a*, 50*b*, and a second upper lever end 72, opposite the first upper lever end 71. In an example, a position of the upper lever 70 relative to the lower lever 50*a*, 50*b* is adjustable by the interconnection of the "T"-shaped connector 75 and the lower lever 50*a*, 50*b*.

In an example, the "T"-shaped connector 75 is selectively positioned within the open center space (e.g., the slot or gab between lever arms) of the dual lower lever 50*a*, 50*b* and is capable of being adjustably positioned anywhere along its length. In an example implementation, with the "T"-shaped connector 75 located proximate to the second end 52 of the lower lever 50*a*, 50*b* and with the downward force 85 (FIG. 2) applied at an end of the single upper lever 70, opposite the "T"-shaped connector 75, the greatest upward force 90 (FIG. 2) is produced.

In an example implementation of use, the removal device 20 provides pressure against grade 80 and serves to remove the stake 15 by application of downward force 85 provided by a user's upper body strength and/or weight that results in an upward force 90 acting on the stake 15.

In various examples, the dimensions of the lower lever 50*a*, 50*b* and/or the upper lever 70 vary depending, for example, on the particular implementation, application, and/or construction. In an example, the lower lever 50*a*, 50*b* and the upper lever 70 are approximately thirty-six inches (36 in.) long and one-half inch (½ in.) wide, in cross-section. In an example construction, the lower lever 50*a*, 50*b* and the upper lever 70 are made from square stock.

In an example construction, the post stand 40, the post 45, the dual lower lever 50*a*, 50*b*, the bearing 55*a*, 55*b*, the axle pin 60, the removal bracket 65*a*, 65*b*, the single upper lever 70, and the "T"-shaped connector 75 are made of metal, such as steel, which can withstand high offset forces without undue deflection. In an example, the various connections, with the exceptions of the bearing 55*a*, 55*b* and the "T"-shaped connector 75 are formed by welding. In other example constructions, However, the post stand 40, the post 45, the dual lower lever 50*a*, 50*b*, the bearing 55*a*, 55*b*, the axle pin 60, the removal bracket 65*a*, 65*b*, the single upper lever 70, and/or the "T"-shaped connector 75 are made from other materials with equivalent strength characteristics and/or other construction processes.

Referring to FIGS. 3-6, in an example, the lower lever 50*a*, 50*b* includes a pair of laterally spaced apart lever members 53. The spaced apart lever members 53 form or otherwise define a slot or gap in the lower lever 50*a*, 50*b* between the lever members 53 that runs from proximate to the first lower lever end 51 to proximate to the second lower lever end 52. In an example, the "T"-shaped connector 35 of the upper lever 70 is located on or is proximate to the first upper lever end 71 of the upper lever 70. The "T"-shaped connector 75 is positioned between the lever members 53 of the lower lever 50*a*, 50*b* (e.g., within the slot formed through the lower lever 50*a*, 50*b*) to removably connect the upper lever 70 to the lower lever 50*a*, 50*b*. In an example, the "T"-shaped connector 75 is movable along a length of the lower lever 50*a*, 50*b* between the second lower lever end 52 and the post 45 to adjust a position of the upper lever 70 relative to the lower lever 50*a*, 50*b*.

In an example, the second post end 47 of the post 45 is positioned between the lever members 53 of the lower lever 50*a*, 50*b*. In an example, the lower lever 50*a* includes a bearing 55*a* connected to each one (1) of the lever members 53 of the lower lever 50*a*. In an example, the device 20 includes the axle pin 60 that extends through an aperture 62 of the second post end 47 of the post 45 and is rotationally connected to the bearing 55*a* of the each one (1) of the lever members 53 of the lower lever 50*a* to enable the lower lever 50*a* to pivot relative to the post 45. In an example, the axle pin 60 is continuous and is routed through two (2) opposing bearings 55*a* with the post 45 in the middle. In another example, the device 20 includes the axle pin 60 that extends through an alternate bearing 55*b* adjacent to and extending away from the second post end 47 of the post 45 and is rotationally connected to the bearing 55*a* of the each one (1) of the lever members 53 of the lower lever 50*b* to enable the lower lever 50*b* to pivot relative to the post 45.

In an example, the removal bracket 65*a*, 65*b* includes a bracket member 66, extending upward from the lower lever 50*a*, 50*b*, and a pair of bracket arms 67, each extending outward from the first lower lever end 51 of the lower lever 50*a*, 50*b*. In an example, the bracket member 66 is configured to support the impact head 60 of the stake 15. In an example, the bracket arms 67 are configured to engage the central shaft 25 of the stake 15 directly below the impact head 30.

In an example, the removal bracket 65*a*, 65*b* of the lower lever 50*a*, 50*b* includes a "U"-shaped bracket, in top view, that forms or otherwise defines a gap 95 or slot to receive and engage the stake 15 directly below the impact head 30 on either side of the central shaft 25. In an example, the removal bracket 65*a*, 65*b* includes a laterally spaced apart pair of bracket arms 67 that define the gap 95 and that are operable to engage the stake 15. In an example, the bracket arms 67 are configured to receive the central shaft 25 of the stake 15 within the slot and contact the impact head 30 of the stake 15. In a first embodiment, the bracket arms 67 of the removal bracket 65*a* are similar or identical in shape and continuous with the lever members 53, with a gap 95 defined therebetween. The bracket member 66 has a width coextensive with the width of the lower lever 50*a*. In another embodiment, the bracket arms 67 of the alternate removal bracket 65*b* are wider than the bracket arms 67 of the previously describe removal bracket 65*a* lever members 53, with a gap 95 defined therebetween. Each bracket arm 67 and the gap 95 of the alternate removal bracket 65*b* is wider than the bracket arm 67 and gap 95 of the previously mentioned removal bracket 65*a*. However, the height of the bracket member 66 of the alternate removal bracket 65*b* is coextensive with the height of the lower members 53 of the lower lever 50*b*.

During periods of non-use, the single upper lever 70 is removable from the dual lower lever 50*a*, 50*b*, for example, by placing them at ninety degrees (90°) relative to each other and removing (e.g., lifting) the "T"-shaped connector 75 from between the dual lower lever 50*a*, 50*b*. This enables the removal device 20 to be collapsed into a relatively small space, thus allowing for easy transport and long-term storage.

Figure 7:
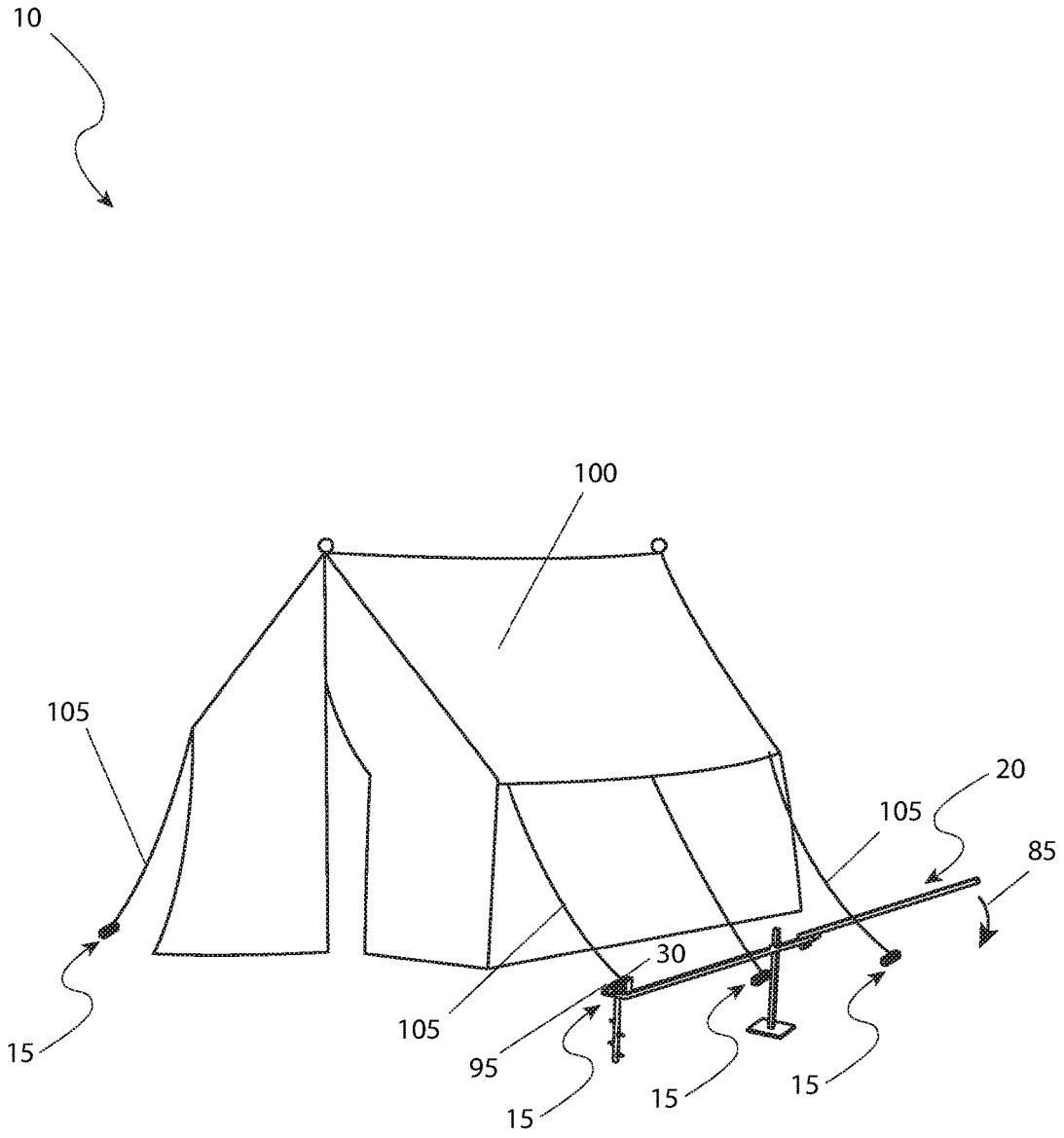

Referring to FIG. 7, in an example implementation of use, a plurality of the stakes 15 are used to tie down and retain a supported structure 100 to the ground. In the illustrative example, the supported structure 100 is a conventional tent that is secured to each one of the stakes 15 by a guy rope 105 in a customary manner. In this example, the disclosed stakes 15 are used in place of conventional tent stakes and are pounded in place during erection of the tent with the guy ropes 105 attached to the stakes 15. Upon the time that the supported structure 100 is to be taken down, the removal device 20 is positioned by each stake 15. The bracket arms 67 are placed such that the gap 95 is under the impact head 30 of the stake 15 and the downward force 85 is applied proximate to the end of the single upper lever 70. This action easily and quickly removes the stake 15 from almost all types of soil or ground hardness. All remaining stakes 15 are engaged and removed in a sequential manner until all are safely removed. Use of the disclosed removal device 20 eliminates potential user injury, damage to the stake 15 and ensures that no stake 15 is left behind where they pose a danger to future users or wildlife.

In an example method of use, the disclosed system 10 can be utilized by the common user in a simple and effortless manner with little or no training. It is envisioned that the system 10 would be constructed in general accordance with FIG. 1-FIG. 3 and FIG. 5, and utilized in general accordance with FIG. 4, FIG. 6, and FIG. 7.

In an example implementation, after procurement or construction of the system 10, it is immediately ready for use. During placement of the stake 15, each stake 15 is pounded into the grade 80 at a desired location, for example, by repeated hammer blows to the impact head 30. The pointed tip 37 enables easy penetration of hard grade 80, while the barbs 35 aid in retainment in loose or soft grade 80. The guy ropes 105 are tied off to the central shaft 25 in a normal manner to support the supported structure 100.

At the necessary removal time, the removal device 20 is placed by each stake 15 with the bracket arms 67 of the removal bracket 65*a*, 65*b* placed under the impact head 30 and the central shaft 25 of the stake 15 positioned within the slot between the bracket arms 95. The downward force 85 is applied by the user. The resultant upward force 90 easily and quickly removes the stake 15 in a controlled manner. After all the stakes 15 are removed, the removal device 20 is disassembled for transport, storage, and future use.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

The invention claimed is:

1. A tie down system comprising:
a tie down stake; and,
a tie down stake removal device;
wherein said tie down stake removal device comprises:
a post stand;
a post comprising:
a first post end connected to said post stand; and,
a second post end opposite said first post end;
a lower lever comprising:
a first lower lever end; and,
a second lower lever end opposite said first lower lever end;
wherein said lower lever is pivotally connected to said second post end of said post between said first lower lever end and said second lower lever end;
an upper lever comprising:
a removal bracket located on said first lower lever end of said lower lever;
wherein a position of said upper lever relative to said lower level is adjustable;
wherein said lower lever further comprises a pair of laterally spaced apart lever members;
said upper lever further comprises a T-shaped connector located on said first upper lever end of said upper lever;
said T-shaped connector is positioned between said lever members of said lower lever to removably connect said upper lever to said lower lever; and,
said T-shaped connector is movable along a length of said lower lever between said second lower lever end and said post to adjust a position of said upper lever relative to said lower lever.

2. The tie down system of claim 1, wherein said tie down stake comprises:
a central shaft comprising:
a first shaft end; and, a second end opposite said first shaft end;

an impact head located at said first shaft end of said central shaft;

a pointed tip located at said second shaft end of said central shaft; and, a plurality of barbs projecting outwardly from said central shaft and located between said first shaft end of said central shaft and said second shaft end of said central shaft.

3. The tie down system of claim 2, wherein each one of said plurality of barbs is longitudinally spaced apart from another one of said plurality of barbs other along a length of said central shaft.

4. The tie down system of claim 2, wherein each one of said plurality of barbs is radially spaced apart from another one of said plurality of barbs about a circumference of said central shaft.

5. The tie down system of claim 1, wherein each one of said plurality of barbs comprises:

a first barb surface projecting perpendicularly outward from said central shaft; and, a second barb surface extending inward from said first bard surface to said central shaft.

6. The tie down system of claim 5, wherein:

said first barb surface is flat; and, said second barb surface has a concave curve.

7. The tie down system of claim 1, wherein:

said second post end of said post is positioned between said lever members of said lower lever;

said lower lever further comprises a bearing connected to each one of said lever members of said lower lever; and, said tie down stake removal device further comprises an axle pin extending through said second post end of said post and rotationally connected to said bearing of said each one of said lever members of said lower lever.

8. The tie down system of claim 1, wherein:

said removal bracket comprises:

a first bracket member extending upward from said lower lever; and, a second bracket member extending outward from said first lower lever end of said lower lever;

said first bracket member is configured to support an impact head of a tie down stake; and, said second bracket member is configured to engage a central shaft of said tie down stake directly below said impact head.

9. The tie down system of claim 8, wherein:

said second bracket portion comprises a laterally spaced apart pair of bracket arms defining a gap; and, said bracket arms are configured to receive said central shaft of said tie down stake within said gap and contact said impact head of said tie down stake.

10. A tie down stake removal device comprising:

a post stand;

a post comprising:

a first post end connected to said post stand; and, a second post end opposite said first post end;

a lower lever comprising:

a first lower lever end; and, a second lower lever end opposite said first lower lever end;

wherein said lower lever is pivotally connected to said second post end of said post between said first lower lever end and said second lower lever end;

an upper lever comprising:

a first upper lever end connected to said lower lever between said post and said second lower lever end of said lower lever; and, a second end opposite said first upper lever end; and, a removal bracket located on said first lower lever end of said lower level;

wherein said lower lever further comprises a pair of laterally spaced apart lever members;

said upper lever further comprises a T-shaped connector located on said first upper lever end of said upper lever;

said T-shaped connector is positioned between said lever members of said lower lever to removably connect said upper lever to said lower lever; and, said T-shaped connector is movable along a length of said lower lever between said second lower lever end and said post to adjust a position of said upper lever relative to said lower lever.

11. The tie down stake removal device of claim 10, wherein:

said second post end of said post is positioned between said lever members of said lower lever;

said lower lever further comprises a bearing connected to each one of said lever members of said lower lever; and, said tie down stake removal device further comprises an axle pin extending through said second post end of said post and rotationally connected to said bearing of said each one of said lever members of said lower lever.

12. The tie down stake removal device of claim 10, wherein:

said removal bracket comprises:

a first bracket member extending upward from said lower lever; and, a second bracket member extending outward from said first lower lever end of said lower lever;

said first bracket member is configured to support an impact head of a tie down stake; and, said second bracket member is configured to engage a central shaft of said tie down stake directly below said impact head.

13. The tie down removal device of claim 12, wherein:

said second bracket portion comprises a laterally spaced apart pair of bracket arms defining a gap; and, said bracket arms are configured to receive said central shaft of said tie down stake within said gap and contact said impact head of said tie down stake.

* * * * *